US005935361A

United States Patent [19]

Takahashi et al.

[11] Patent Number: 5,935,361

[45] Date of Patent: Aug. 10, 1999

[54] WEB SPLICING PREPARATION METHOD AND APPARATUS

[75] Inventors: Hisashi Takahashi; Mamoru Fujisawa; Yoshio Kawakami, all of Minami-Ashigara, Japan

[73] Assignee: Fuji Photo Film Co., Ltd., Kanagawa, Japan

[21] Appl. No.: 08/895,569

[22] Filed: Jul. 16, 1997

[30] Foreign Application Priority Data

Jul. 17, 1996 [JP] Japan ..... 8-187701
Aug. 9, 1996 [JP] Japan ..... 8-211687

[51] Int. Cl.[6] ..... B65H 21/00

[52] U.S. Cl. ..... 156/159; 156/505; 156/507; 242/553; 242/554.2

[58] Field of Search ..... 156/157, 159, 156/505, 507; 242/553, 554.1, 554.2, 555.2, 555.5, 556.1

[56] References Cited

U.S. PATENT DOCUMENTS

| | | | |
|---|---|---|---|
| 4,657,198 | 4/1987 | Shimizu et al. | 242/57 |
| 4,802,632 | 2/1989 | Fukuda et al. | 242/58.5 |
| 5,762,283 | 6/1998 | Buchmeyer et al. | 242/532.3 |

FOREIGN PATENT DOCUMENTS

| | | | |
|---|---|---|---|
| 0 547 500 A1 | 6/1993 | European Pat. Off. | B65H 19/18 |
| 62-285854 | 12/1987 | Japan | B65H 19/18 |
| 3-13144 | 2/1991 | Japan | B65H 19/18 |
| 3-56348 | 3/1991 | Japan | B65H 23/198 |
| 4 066465 | 3/1992 | Japan . | |
| 6 278925 | 10/1994 | Japan . | |
| 7-304561 | 11/1995 | Japan | B65H 43/02 |
| 8-644 | 1/1996 | Japan | B65H 19/18 |
| 95/20537 | 8/1995 | WIPO | B65H 19/12 |

*Primary Examiner*—Mark A. Osele
*Attorney, Agent, or Firm*—Sughrue, Mion, Zinn, Macpeak & Seas, PLLC

[57] ABSTRACT

An original roll positioning device sets a position of an end face of a new roll at a predetermined reference position. An end pull-out device sucks and pulls out the leading end of the new web from the positioned new roll at a predetermined length. A pair of roll-up chucks of an end roll-up device holds both sides of the leading end of the pulled-out web, and the roll-up chucks are rotated to roll up the leading end of the web at a predetermined length. A suction box sucks the web at a part between the roll up chucks and the roll, and then a cutter cuts the web along the width of the web to form a splicing part. The splicing part is sucked by the suction box, and the spliced part is made to wait in this state until the start of the splicing operation.

17 Claims, 11 Drawing Sheets

WEB SPLICING PREPARATION METHOD AND APPARATUS

BACKGROUND OF THE INVENTION

1. Field of the Invention

The present invention relates generally to an apparatus which prepares for splicing webs (long flexible sheet materials such as plastic film, paper and foil) which are being transferred, and more particularly to web splicing preparation method and apparatus which are applied to a web feeding apparatus for a coater, a cutter, and so forth.

2. Description of Related Art

Japanese Patent Provisional Publication No. 62-285854 (hereafter referred to as "a prior art A"), Japanese Patent Publication No. 3-13144 (hereinafter referred to as "a prior art B") and Japanese Patent Provisional Publication No. 3-56348 (hereinafter referred to as "a prior art C") have disclosed preparing for splicing webs of new and old rolls together.

On the other hand, concerning techniques for estimating a residual length of a roll, Japanese Patent Publication No. 8-644 has disclosed an automatic paper splicing method, and Japanese Patent Provisional Publication No. 7-304561 has disclosed an apparatus for displaying a residual length of a roll. According to these techniques, a web feeding speed and a rotating speed of the roll are measured during the feeding, and then the diameter of the roll in use is calculated according to the above-mentioned speeds, and the residual length of the roll is calculated according to the calculated diameter of the roll, the diameter of the core of the roll and the thickness of the web.

In the case of a photosensitive material such as a roll of photographic printing paper, since a part which is adjacent to the seam of the spliced webs is sometimes put on the market, the web of the periphery of the original roll should be disposed before the splicing operation. The prior arts A, B and C have a disadvantage because an operator has to dispose the web of the periphery of the original roll.

A scrap web, which was the web of the periphery of the original roll and was cut off from the leading end of the new web, is rolled up to be a small roll so as to save a disposal space. The prior arts A, B and C have a disadvantage because the operator has to roll up the scrap web.

In the case of the rolls of photographic printing paper, the spliced parts of the new and old webs are overlapped and welded together by heat or ultrasonic vibrations. This splicing operation requires the positional accuracy of the spliced parts not only in a width direction but in a longitudinal direction. The prior arts A and B can secure the positional accuracy in the width direction of the leading end of the new web, but not in the longitudinal direction. The prior art A can secure the positional accuracy in the longitudinal direction of the leading end of the new web, but not in the longitudinal direction of the trailing end of the old web. In the prior art A, the splicing is performed by means of adhesive tape.

In the case of the rolls of photographic printing paper, it is necessary to punch a hole for indicating the seam, which is called an ISO hole, on the proximity of the seam of the new and old webs. In the prior arts A and B, the ISO hole cannot be punched in the proximity of the leading end of the new web before the splicing operation. The ISO hole can be punched only after the splicing operation, and thus splicing time is wasted.

The prior art A has a disadvantage in that the operator has to set a web holder, which pulls out the leading end of the new web from the new roll, at the leading end of the new web and recover the web holder and the scrap web after the splicing operation. In particular, the web holder must be recovered after the splicing operation every time the rolls are exchanged. In the prior arts B and C, the operator has to pull out the leading end of the new web from the new roll every time the rolls are exchanged.

In the prior art B, a part on the proximity of the leading end of the new web rubs against a suction conveyor when the web is positioned in the width direction. Then, there may be scratches, etc. on the part of the new web, and the part cannot be put on the market.

On the other hand, in the conventional roll residual length estimating method and apparatus, the diameter of the roll is calculated according to the web feeding speed and the rotating speed of the roll during the feeding. That is, the unevenness of the cores in diameter is not taken into consideration. Consequently, the residual length of the roll cannot be correctly determined due to the unevenness.

In the case of Japanese Patent Publication No. 8-644, the operator measures the diameter of the core every time so as to consider the unevenness of the cores in diameter. Then, the operator has to take the trouble of measuring the diameter of the core every time, and the time of operation of the apparatus is wasted. If the web is a photosensitive material such as photographic film and photographic printing paper, the apparatus is installed in a darkroom, and hence there are hazards connected with measuring the diameter of the core, and the measurement cannot be correctly performed.

SUMMARY OF THE INVENTION

The present invention has been developed in view of the above-described circumstances, and has as its object the provision of a web splicing preparation method and apparatus which can eliminate the disadvantages in the prior arts, and a web splicing preparation apparatus which is provided with a roll residual length determining device.

To achieve the above-mentioned object, a web splicing preparation method of preparing a trailing end of an old web of an old roll for splicing with a splicing part of a new web of a new roll according to the present invention, the method comprises the steps of: rolling up a leading end of the new web at a predetermined length with an end roll-up means; moving the end roll-up means to unwind the new web from the new roll; holding the new web at a position between the rolled-up leading end and the new roll with a holding means; cutting off the rolled-up leading end of the new web from the held part of the new web with a cutting means, and thereby forming the splicing part; and having the splicing part of the new web wait in a state of being held with the holding means until the start of the splicing operation.

According to the present invention, the end roll-up means rolls up the leading end of the new web from the new roll at a predetermined length. Then, the end roll-up means is moved over the holding means, and the new web is unwound from the new roll. Next, the holding means holds the new web at the part between the rolled-up leading end and the new roll. The cutting means cuts off the rolled-up leading end of the new web from the held part of the new web to form the splicing part of the new web, and the splicing part is made to wait in the held state until the start of splicing operations. Thus, in the present invention, the web of the periphery of the new roll is rolled up at a predetermined length and is disposed, so that there is no scratch on the part on the proximity of the seam of the new web of the new roll.

In the present invention, the residual length of the roll is determined according to the thickness of the roll on the core and the diameter of the core. The thickness of the roll is calculated by subtracting a distance between a distance measuring sensor and a circumferential surface of the roll from a previously-stored distance between the distance measuring sensor and the circumferential surface of the core.

In the prior arts, the unevenness in core diameter has much effect on the estimated residual lengths of the rolls. For example, in the case of rolls having the same diameters, in which a web having the thickness of 0.2 mm is wound on cores whose reference diameter is 300 mm and actual diameters vary within the limit of ±1 mm, a difference ΔL in the residual length between a roll having a core of 301 mm in diameter and a roll having a core of 299 mm in diameter is $$\begin{aligned}\Delta L &= L_{301} - L_{299}\\ &= 1/4\times\pi\times 301^2/0.2 - 1/4\times\pi\times 299^2/0.2\\ &= 1/4\times\pi\times(301^2 - 299^2)/0.2\\ &= 4712\,\text{mm}.\end{aligned}$$

On the other hand, in the present invention, the determination error can be significantly decreased as is clear from the following example. In the case of rolls having the same difference in core thickness of 1 mm on the cores, a difference ΔL' in the residual length between the roll having the core of a 301 mm in diameter and the roll having the core of 299 mm in diameter is $$\begin{aligned}\Delta L' &= L'_{301} - L'_{299}\\ &= \pi\times 301^2\times 1/0.2 - \pi\times 299\times 1/0.2\\ &= \pi\times(301 - 299)/0.2\\ &= 31\,\text{mm}.\end{aligned}$$

The diameters of the cores generally vary a little as stated above. Moreover, there is a little unevenness on the circumferential surface of the core, and the core is not completely round. Further, the core is rotated in a state that the axis of the core is displaced with respect to the center of rotation. Furthermore, in a turret type feeding device, the position of the roll varies. Consequently, it is difficult to accurately measure the thickness of the roll on the core.

To eliminate the above-described disadvantages and measure the thickness of the roll based on the circumferential surface of the core, in the present invention, a pair of rollers is pressed on the circumferential surface of the core, and the distance measuring sensor is attached to a supporting member which rotatably supports the pair of rollers, and a detection surface of the distance measuring sensor faces to the circumferential surface of the roll. The supporting member is supported in such a manner as to be movable in a circumferential direction of the core, and thereby the distance measuring sensor always faces to the center of the core such that the distance from the circumferential surface of the core can be fixed.

Thus, even if the cores vary in diameter, the distance between the distance measuring sensor and the circumferential surface of the core can be fixed. The fixed distance is stored in a controller, and then a distance between the distance measuring sensor and the circumferential surface of the roll, which is measured by the distance measuring sensor, is subtracted from the above-mentioned fixed distance. Thereby, in the present invention, the thickness of the roll can be accurately measured, and thus, the residual length of the roll can be correctly determined. The controller stops feeding the web when the determined residual length of the roll is less than a reference value.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The invention will be described in further detail by way of example with reference to the accompanying drawings.

Figure 1:
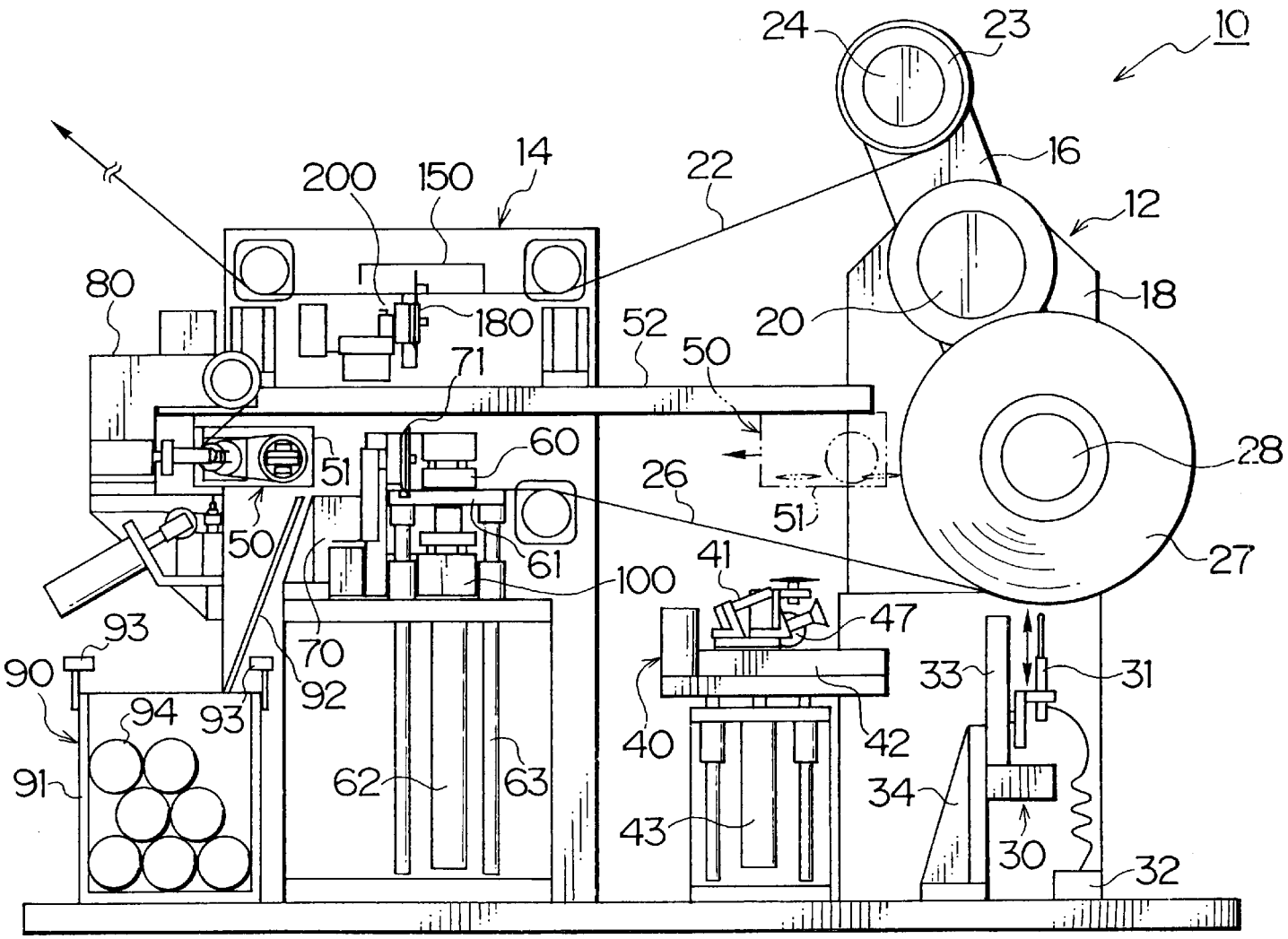
FIG. 1 is a view illustrating the entire structure of a web splicing preparation apparatus according to an embodiment of the present invention.

FIG. 1 is a view illustrating the entire structure of a web splicing preparation apparatus for this embodiment. The web splicing preparation apparatus in FIG. 1 consists of a web supply part 12 and a web cutting and splicing part 14. In the web supply part 12, a turret arm 16 is rotatably supported on a column 18 with a shaft 20. A core 24 of an old roll 23 for an old web 22 is rotatably attached to one end of the turret arm 16 in such a manner as to be movable in the axial direction, and a core 28 of a new roll 27 for a new web 26 is rotatably attached to the other end of the turret arm 16 in such a manner as to be movable in the axial direction. The old web 22 is fed from the web supply part 12 to a coater (not shown) through the cutting and splicing part 14.

On the other hand, an original roll positioning device 30 positions the new roll 27 in the width direction, and then an end pull-out device 40 pulls out the leading end of the new web 26 at a predetermined length from the new roll 27. Then, both sides of the leading end of the web 26 are nipped by a pair of roll-up chucks 53 (see FIG. 4) of a roll-up device 50 indicated with alternate long and two short dashes lines. Thereafter, the pair of the roll-up chucks 53 is moved with the roll-up device 50 to the downstream of a holding device 60, so that the web 26 can be unwound from the new roll 27. Then, the web 26 is held by a suction box 61 at a part between the leading end thereof and the new roll 27 and is cut with a cutting device 70, and thereby a splicing part is formed. A scrap web, which has been rolled up by the roll-up chucks 53 and cut off from the web 26, is fixed with adhesive tape in the rolled-up state by a tape sticking device 80, and then the rolled-up scrap web is automatically discharged into a storage box 90. An ISO hole punching device 100 punches an ISO hole on the proximity of the splicing part (new leading end) of the web 26, which was cut by the cutting device 70.

Figure 2:
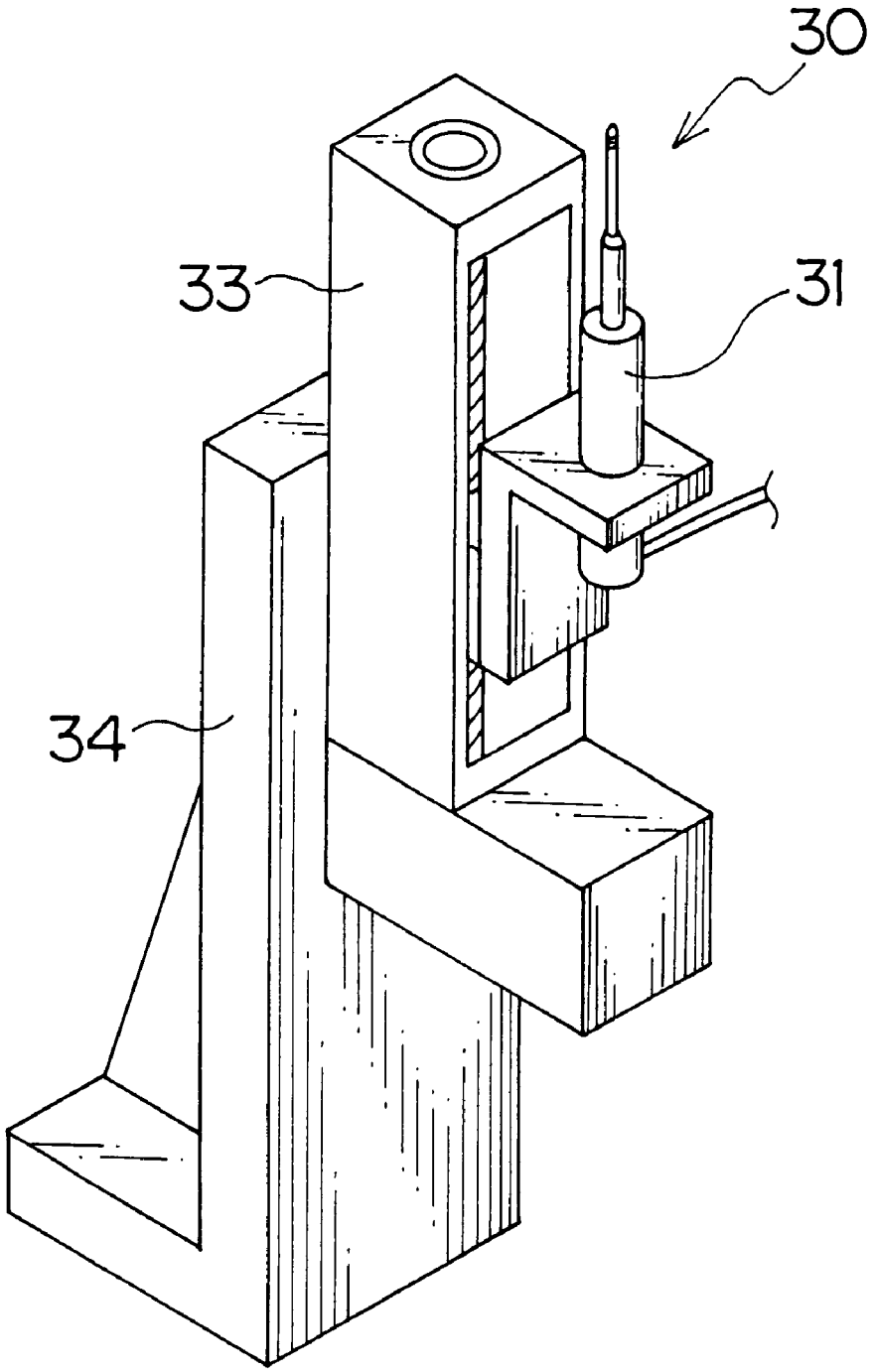
FIG. 2 is a perspective view illustrating an original roll positioning device applied to the web splicing preparation apparatus.

FIG. 2 is a perspective view of the original roll positioning device 30. The original roll positioning device 30 consists of a distance measuring sensor 31, which measures a distance to the circumferential surface of the new roll 27, a controller 32, which receives a distance signal from the distance measuring sensor 31 and processes the signal by comparing it with a reference value, and a moving mechanism 33, which moves the distance measuring sensor 31 in the direction of a radius of the new roll 27. The distance measuring sensor 31 and the moving mechanism 33 are placed on a L-shaped supporting base 34.

A non-contact measuring sensor, an ultrasonic sensor, etc. as well as an analog output contact displacement sensor may be used as the distance measuring sensor 31.

On the other hand, a ball screw mechanism, which is composed of a ball screw, a motor, a guide, etc., as well as a single shaft robot may be used as the moving mechanism 33. If positions of end faces of the original rolls to be positioned are fixed at one position, the position of the distance measuring sensor 31 in the axial direction of the roll is matched with the one position. If the positions of the end faces of the original rolls to be positioned is not fixed at one position, an axial direction moving mechanism may be provided in order to move the distance measuring sensor 31 in the axial direction of the original roll.

The end pull-out device 40 in FIG. 1 consists of an end pull-out unit 41, a diameter direction moving part 42 for moving the end pull-out unit 41 in the diameter direction of the new roll 27, and a vertical moving part 43 for moving up and down the end pull-out unit 41.

Figure 3:
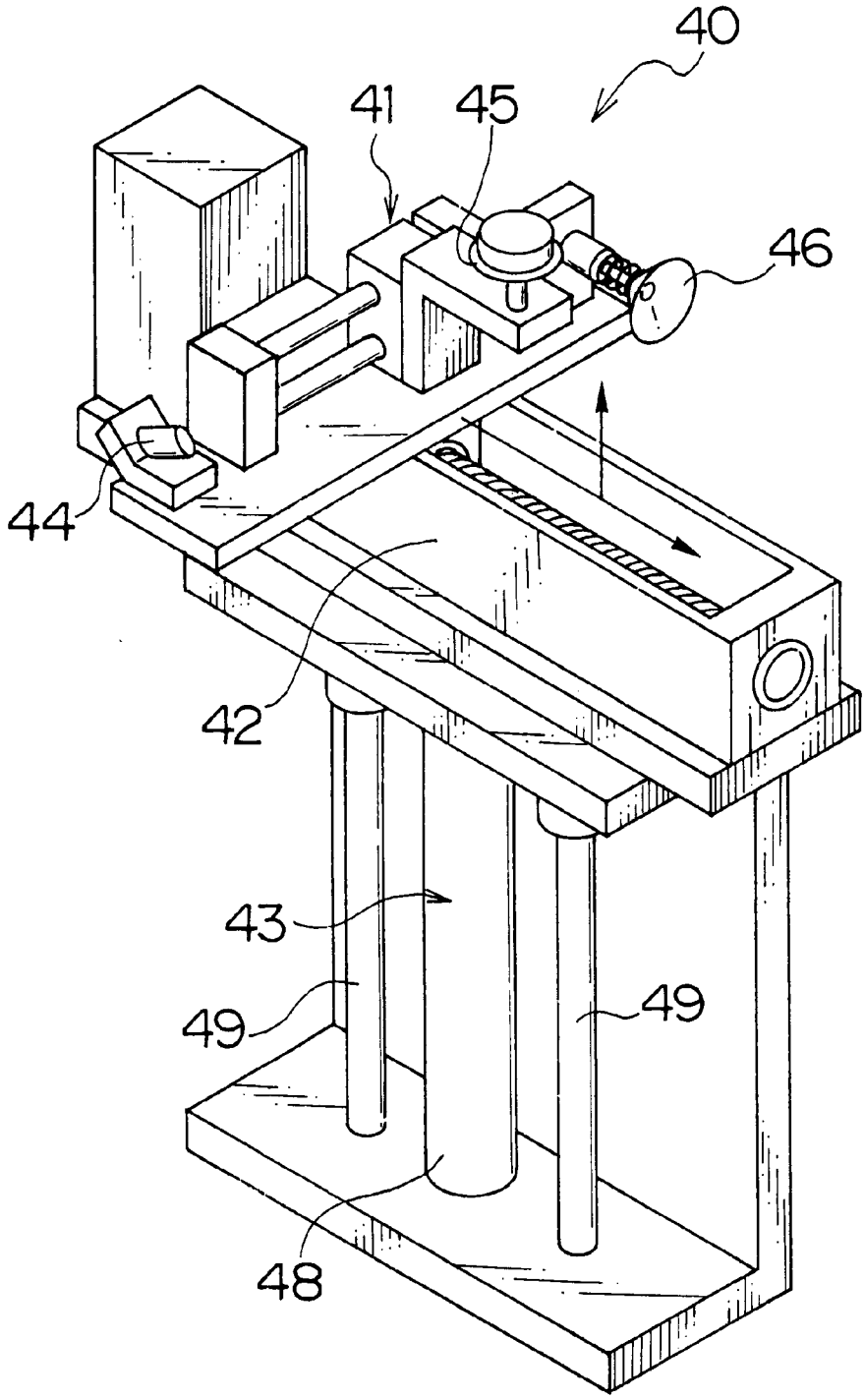
FIG. 3 is a perspective view illustrating an end pull-out device applied to the web splicing preparation apparatus.

As shown in FIG. 3, the end pull-out unit 41 consists of an end detecting sensor 44 for detecting the leading end of the new web 26 on the new roll 27, a tape cutter 45 for cutting adhesive tape which fixes the leading end of the new web 26 on the periphery of the new roll 27, an end holding pad 46 for holding a part in the proximity of the leading end of the new web 26, and a holding pad driving part 47 (see FIG. 1) for pulling out the leading end of the new web 26 from the new roll 27 by rotating the end holding pad 46.

A ball screw mechanism, which is composed of a ball screw, a motor, a guide, etc., is used as the diameter direction moving part 42, and a jack mechanism, which is composed of an air cylinder 48 and a pair of guide rods 49, is used as the vertical moving part 43.

An ultrasonic sensor is used as the end detecting sensor 44. By using the ultrasonic sensor, if the distance and angle with respect to the circumferential surface of the new roll 27 are within proper range, a small difference in level of about 0.1 mm can be detected. If the web 26 is thick to some extent, the difference in level can be directly (or by amplifying the difference with a lever, etc.) detected by a contact sensor.

The tape cutter 45 consists of a round blade, a blade pushing mechanism, which presses the round blade against the circumferential surface of the new roll 27 with a proper pressure, and a cutter moving mechanism, which moves the round blade and the blade pressing mechanism in the direction of the width of the new roll 27.

A holding pad on the market may be used as the end holding pad 46, and a plurality of holding pads are preferably lined up in the direction of the width of the new roll 27.

A single shaft robot on the market as well as a ball screw mechanism composed of a ball screw, a guide, etc. may be used as the diameter direction moving part 42.

A rotary actuator may be used as the holding pad driving part 47.

The roll-up device 50 in FIG. 1 consists of a pair of roll-up units 51 and a moving mechanism 52 which moves the pair of the roll-up units 51 back and forth between the web supply part 12 and the web cutting and splicing part 14.

Figure 4:
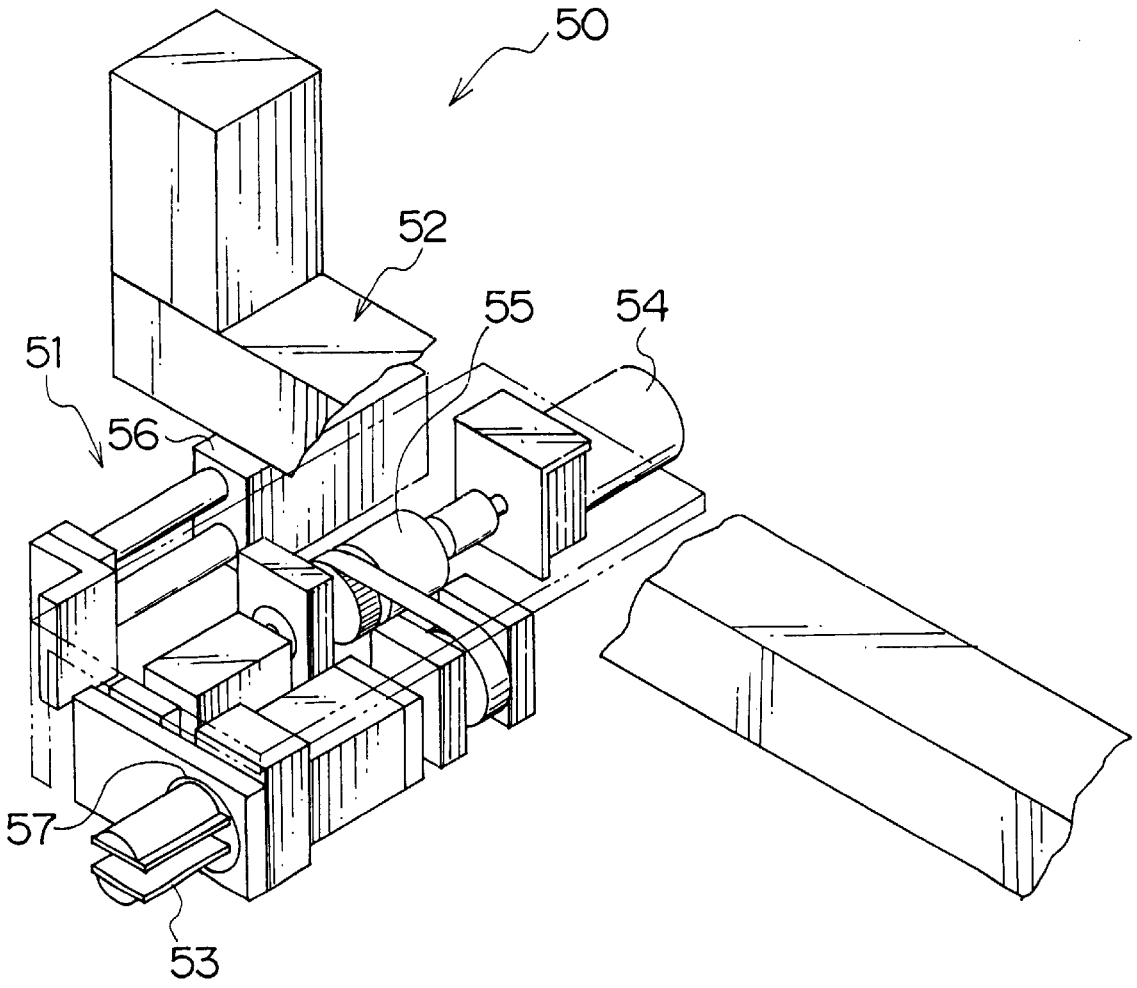
FIG. 4 is a perspective view illustrating an end roll-up device applied to the web splicing preparation apparatus.

As shown in FIG. 4, the roll-up unit 51 consists of the roll-up chuck 53, which nips one side of the leading end of the new web 26, a motor 54, which rotates the roll-up chuck 53, a torque controlling part 55, which is arranged between the roll-up chuck 53 and the motor 54 and restricts the torque transmitted to the roll-up chuck 53, a chuck moving part 56, which moves the roll-up chuck 53 in the width direction of the web 26, and a pull ring 57.

In the roll-up chuck 53, an inner chuck and an outer chuck are attached to a parallel opening and closing type air chuck on the market. Because of such a construction, the diameter of the roll-up chuck 53 in a chucking state is larger than that in an unchucking state, so that a rolled-up web can be rolled into a cylinder and easily removed from the roll-up chuck 53 after the roll-up operation.

A variety of sliding clutches may be used as the torque controlling part 55. A single shaft robot on the market may be used as the moving mechanism 52.

Figure 5:
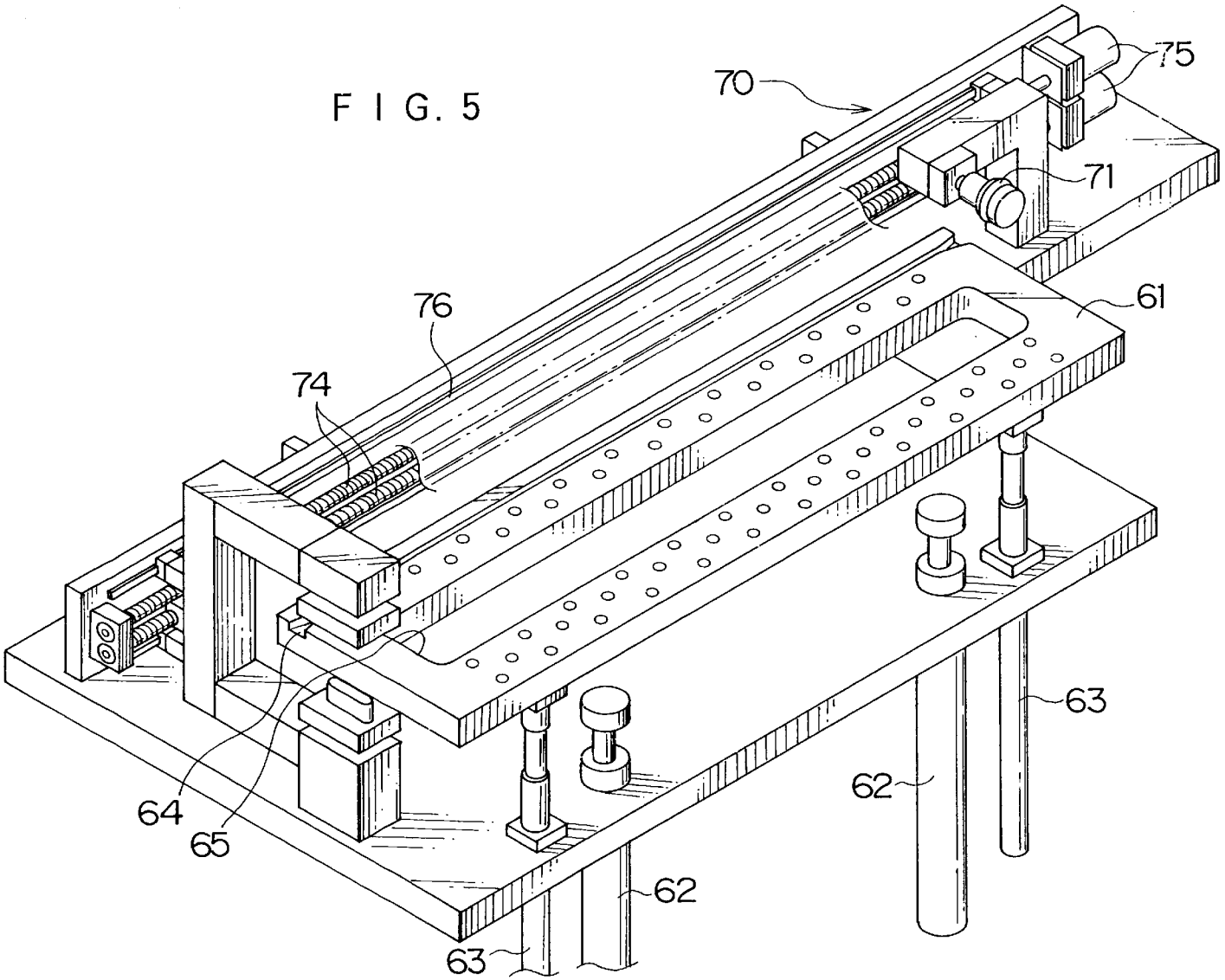
FIG. 5 is a perspective view illustrating a suction box and a cutting device applied to the web splicing preparation apparatus.

The holding device 60 in FIG. 5 consists of the frame-shaped suction box 61, a pair of air cylinders 62 which moves the suction box up and down, and a pair of guide rods 63. A groove (lower edge) 64 for receiving a cutter 71 of the cutting device 70 (see FIG. 6), and a clearance hole 65 for operation of the ISO hole punching device 100 (see FIG. 7), are formed in the suction box 61.

Figure 6:
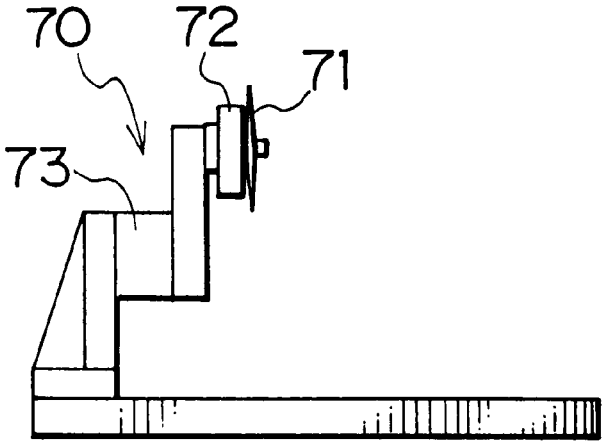
FIG. 6 is a front view illustrating the cutting device applied to the web splicing preparation apparatus.

As shown in FIG. 6, the cutting device 70 consists of a cutter unit, which is composed of a cutter 71 and a cutter holder 72 for rotatably supporting the cutter 71, and a moving mechanism 73 for moving the cutter unit in the width direction of the new web 26.

As shown in FIG. 5, a ball screw mechanism which is composed of ball screws 74, motors 75, a guide 76, etc., is used as the moving mechanism 73. Otherwise, an air cylinder mechanism or a single shaft robot may be used.

Figure 8:
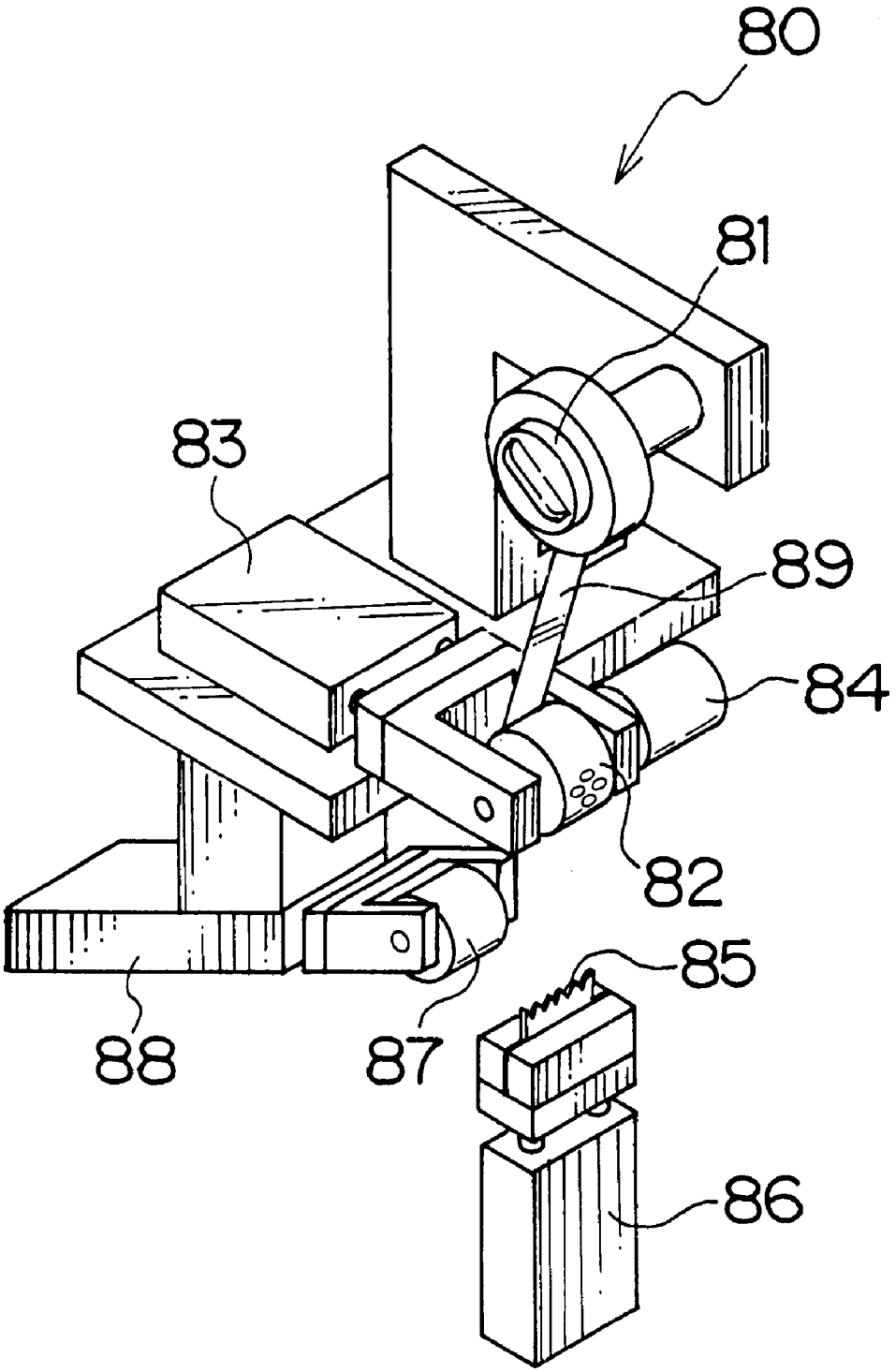
FIG. 8 is a perspective view illustrating a tape sticking device applied to the web splicing preparation apparatus.

The tape sticking device 80 in FIG. 8 consists of a supply part 81, which rotatably supports a roll of the adhesive tape, a tape suction drum 82, a tape suction drum moving part 83, a tape suction drum driving mechanism 84, a cutter 85, a cutter moving mechanism 86, a pressing roll 87 for preventing the rolled-up scrap web from being unrolled, and a pressing roll moving mechanism 88. Reference numeral 89 is the adhesive tape.

An adhesive tape, etc. on the market which has an adhesive face on one side may be used as the adhesive tape 89.

Suction holes for fixing the adhesive tape 89 are formed on the circumferential surface of the tape suction drum 82, and the suction holes are connected to a vacuum pump via a valve (not shown). A groove (not shown) for the cutter 85 to recess is formed on the circumferential surface of the tape suction drum 82. The circumferential surface of the tape suction drum 82 preferably has a low frictional coefficient so as to reduce a running resistance of the adhesive tape 89.

An air cylinder, etc. on the market may be used as the tape suction drum moving part 83, and a rotary actuator, etc. on the market may be used as the tape suction drum driving mechanism 84.

A safety cutter, a razor, the teeth of a saw, etc. on the market may be used as the cutter 85. An air cylinder, etc. on the market may be used as the cutter moving mechanism 86 and the pressing roll moving mechanism 88.

If an adhesive tape having a strong adhesiveness or an adhesive tape having a non-adhesive face of high coefficient of friction is used as the adhesive tape 89, there may be provided a tape pull-out roll, which is driven by an air cylinder, on a passage of the adhesive tape 89.

The storage box 90 in FIG. 1 consists of a stocker 91, a guide 92 and a passage confirmation sensor 93.

Figure 7:
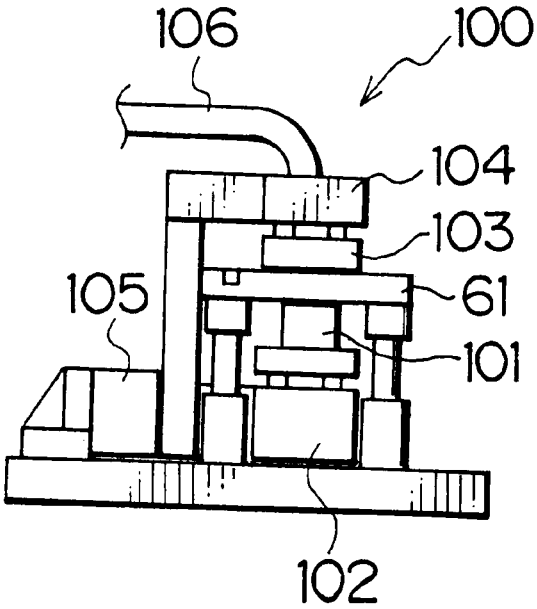
FIG. 7 is a front view illustrating an ISO hole punching device applied to the web splicing preparation apparatus.

As shown in FIG. 7, the ISO hole punching device 100 consists of an ISO hole punching unit, which is composed of a punch 101, a punch up and down mechanism 102, a die 103 and a die up and down mechanism 104, and a moving mechanism 105 which moves the ISO hole punching unit along the width of the new web 26. The die 103 is connected with a suction hose 106, which collects punch trash.

An air cylinder, etc. on the market may be used as the punch up and down mechanism 102 and the die up and down mechanism 104. A single shaft robot, etc. on the market may be used as the moving mechanism 105.

The ISO hole punching unit of the ISO hole punching device 100 and the cutter unit of the cutting device 70 are usually capable of preventing themselves from interfering with one another by waiting on both sides of the new web 26. This is the same case with a cutter for the old web 22 and the splicing device.

Next, an explanation will be given about the operation of the web splicing preparation apparatus 10 which is constructed in the above-mentioned manner.

In order to position the new roll 27, the core 28 is moved in the axial direction until the circumferential surface of the new roll 27 is positioned over the distance measuring sensor 31. Then, the moving mechanism 33 lifts the distance measuring sensor 31 until the distance between the distance measuring sensor 31 and the circumferential surface of the new roll 27 becomes within a proper distance, and the distance measured by the distance measuring sensor 31 is captured into a memory in the controller 32 as a reference distance. Then, the core 28 is moved in the reverse direction until the difference between the reference distance and the measured distance reaches a predetermined set value, and thereby the new roll 27 is positioned.

Thus, the side of the outermost part of the new roll 27 can be correctly positioned, even though the web 26 is not steadily wound on the new roll 27. Moreover, even if the diameters of the original rolls are not uniform, the moving unit 33 can be easily positioned in the diameter direction of the roll by means of the distance measuring sensor 31.

Next, an explanation will be given about the operation of pulling out the leading end of the new web 26 on the new roll 27 with reference to FIGS. 1 and 3.

First, the vertical moving part 43 lifts the end pull-out unit 41 so that the height of the tape cutter 45 of the end pull-out device 40 can correspond to that of the axis of the new roll 27. The diameter direction moving part 42 moves the end pull-out unit 41 toward the new roll 27 until the distance between the end detecting sensor 44 and the circumferential surface of the new roll 27 becomes within a predetermined distance which is appropriate for detecting the leading end of the new web 26 on the new roll 27. Then, the core 28 is rotated until the end detecting sensor 44 detects the leading end of the web 26. Thereafter, the diameter direction moving part 42 moves the end pull-out unit 41 to the new roll 27 so that the round blade of the tape cutter 45 is pressed against the circumferential surface of the new roll 27 with a proper pressure. The holding pad 46 holds the part in the proximity of the leading end of the web 26, and a cutter moving mechanism moves the tape cutter 45 along the width of the new roll 27 so as to cut the adhesive tape which fixes the leading end of the web 26 on the new roll 27. After the core 28 is slightly rotated to slack off the web 26, the holding pad driving part 47 rotates the holding pad 46, so that the leading end of the web 26 can be pulled out from the new roll 27.

Next, an explanation will be given about the roll-up of the leading end of the new web 26 with reference to FIG. 4.

First, the phase of the pair of the roll-up chucks 53 is adjusted by rotating the motors 54 at a low speed. Then, the moving mechanism 52 moves the pair of the roll-up units 51 until the pair of the roll-up chucks 53 reaches the leading end of the pulled-out web 26. The chuck moving parts 56 move the roll-up chucks 53 so that the sides of the leading end of the web 26 can be located between the internal chucks. Next, the roll-up chucks 53 are closed, and both sides of the leading end of the web 26 are nipped. Then, the motors 54 and the core 28 are rotated so as to start rolling-up the leading end of the web 26, and the moving mechanism 52 moves the roll-up units 51 to a final position, where is represented with solid lines in FIG. 1, in a proper timing sequence. When the movement of the roll-up units 51 to the final position is completed and the rolled-up length of the web 26 reaches a predetermined length, the motors 54 and the core 28 are stopped.

Then, the suction box 61 of the holding device 60 in FIG. 5 holds the web 26 at the part between the roll-up device 50 and the new roll 27, and the cutter 71 of the cutting device 70 is moved to cut the web 26, so that the splicing part of the web 26 can be formed.

Next, an explanation will be given about the processing of the scrap web with reference to FIG. 8.

Before the web 26 is cut, the pressing roll moving mechanism 88 presses the pressing roll 87 against the circumferential surface of the rolled-up leading end of the web 26. After the rolled-up leading end is cut off from the web 26, the pair of the motors 54 (see FIG. 4) is rotated for a predetermined time so that the whole of the scrap web can be rolled up by the roll-up chucks 53. The tape suction drum driving part 84 rotates the tape suction drum 82 so that the leading end of the adhesive tape 89 faces to the rolled-up scrap web. Thereafter, the tape suction drum moving part 83 presses the leading end of the adhesive tape 89 which is fixed on the tape suction drum 82 against the circumferential surface of the rolled-up scrap web, and the suction of the tape suction drum 82 is released. Then, the pressing roll moving mechanism 88 moves the pressing roll 87 to the original position. The pair of the motors 54 is rotated again for a predetermined time, and thereby the rolled-up scrap web rotates and the adhesive tape 89 is stuck on the rolled-up scrap web. On the other hand, the tape suction drum 82 is moved to the original position in a proper timing sequence by the tape suction drum moving part 83 and the tape suction drum driving mechanism 84. After that, the tape suction drum 82 fixes the adhesive tape 89 thereon, and the cutter moving mechanism 86 moves the cutter 85, and thereby the adhesive tape 89 is cut.

Then, the nipping of the pair of the roll-up chucks 53 is released, and the chuck moving parts 56 move the roll-up chucks 53 so that the pair of the roll-up chucks 53 are moved away from each other. Thereby, the rolled-up scrap web is separated from the roll-up chucks 53 on the pull rings 57 and falls into the stocker 91 via the guide 92 in FIG. 1. At that time, the passage confirmation sensor 93 detects that the rolled-up scrap web 94 has fallen without fail. The scrap of the web, which is wide and does not have enough rigidity, can be rolled up by the simple device in the above-stated splicing method.

Next, an explanation will be given about the operation of the ISO hole punching device 100 with reference to FIG. 7.

First, the moving mechanism 105 positions the ISO hole punching unit at a position corresponding to the clearance hole 65 of the suction box 61 (see FIG. 5). Then, the die up and down mechanism 104 lowers the die 103, and the punch up and down mechanism 102 raises the punch 101, and thereby the ISO hole is punched on the proximity of the splicing part of the web 26. After punching, the die up and down mechanism 104 and the punch up and down mechanism 102 move the die 103 and the punch 101 to the original positions. While the ISO hole is punched, the punch trash is collected via the suction hose 106.

Next, an explanation will be given about the splicing of the old web 22 and the web 26 with reference to FIG. 1.

When the use of the old web 22 of the old roll 23 is finished, the old web 22 is held by a holding device 150 and is cut with the cutting device 180. The old web 22 remaining on the old roll 23 side is wound up by the rotation of the core 24. On the other hand, the core 28 of the new roll 27 is slightly rotated to slack off the new web 26 as required, the moving mechanism 62 raises the suction box 61, and the splicing part of the new web 26 is passed on to the holding device 150 on the old web 22 side. The moving mechanism 62 lowers the suction box 61 to the original position, and then an ultrasonic splicing device 200 moves along the width of the webs, and the new and old webs are spliced together.

In the above-stated splicing method, the splicing part of the new web 26 after the roll-up and cut-off of the leading end of the new web 26 can be easily matched with the position in the width direction of the old web 22.

In the roll-up of the leading end of the new web, if both sides of the leading end of the web are only held without use of a core, etc., and particularly if the wide web is used, the central part of the web is bent at the start of the roll-up. To eliminate such a disadvantage, the core, a wrapper, a wind guide, etc. were used in the past. If such auxiliary equipment is used; however, the apparatus is complicated. In the present invention, no auxiliary equipment is required, and a roll-up tensile force (to be particular, the roll-up torque) is set within a proper range, so that the wide web can be rolled up by holding only both sides of the leading end of the web. This has been proved by the following experiment.

The proper roll-up torque varies according to the width and thickness of the web, the shape of the roll-up chuck, the feeding speed, the roll-up speed, etc. For example, the proper roll-up torque is between 4 kgf-cm and 7 kgf-cm on condition that the diameter of the roll-up chuck is 50 mm, a chucking margin of the roll-up chuck is between 40 mm and 80 mm in the width direction, preferably between 50 mm and 70 mm, the feeding speed is between 3 m/min and 12 m/min, and the roll-up speed is 13 m/min in the case of the photographic print paper roll which has the width of between 1000 mm and 1500 mm and the web thickness of between 0.14 mm and 0.28 mm.

As a specific means for securing the above-stated torque (tensile force), a tension bar disclosed by Japanese Patent Provisional Publication No. 4-46062 is not required, and a frictional clutch which generates a constant torque is provided between the roll-up chuck and the roll-up motor.

In order to obtain the positional accuracy of the new web in the direction of the width of the new roll after the roll-up of the leading end of the new web, it is necessary to prevent the web from slacking when the leading end of the web is pulled out and rolled up. If the web is slacking, the rolled-up web is wound thick, and the positional accuracy in the direction of the width of the web is lowered. To prevent the web from slacking, the frictional clutch which generates a constant torque is provided between the roll-up chuck and the roll-up motor, and a moving speed $V_t$ of the roll-up chuck when the web is pulled out, a roll-up speed $V_m$ of the roll-up chuck and the web feeding speed $V_u$ are controlled to have the following relation:

$$V_u - V_m \leq V_t \leq V_u$$

In addition, the roll-up torque and the diameter of both roll-up chucks should be equal when the web is rolled up. For example, the web is rolled up about 3 m on condition that the diameter of the roll-up chuck is 50 mm, the chucking margin of the roll-up chuck is between 40 mm and 80 mm, preferably between 50 mm and 70 mm, the feeding speed is 12 mm, the roll-up speed is 13 m/min, and a basic roll-up torque is 5.5 kgf-cm. In this case, the effect on the positional accuracy in the direction of the width of the web which has been rolled up is about 0.5 mm per 1 kgf-cm change of the roll-up torque, and the effect on the positional accuracy in the direction of the width of the web which has been rolled up is about 1 mm per 1 mm change of the diameter of the roll-up chuck.

Thus, if the position of the end face of the new roll is matched with the position of the web of the old roll, the position in the direction of the width of the new web can be correctly maintained with respect to the position of the new roll after the leading end of the new web is pulled out and rolled up.

Figure 9:
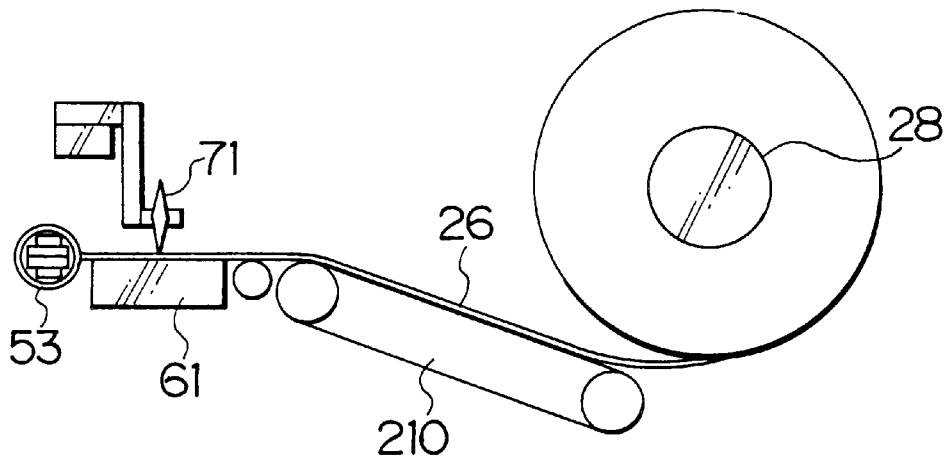
FIG. 9 is a view of assistance in explaining the essential parts of another embodiment for the web splicing preparation apparatus.
Figure 10:
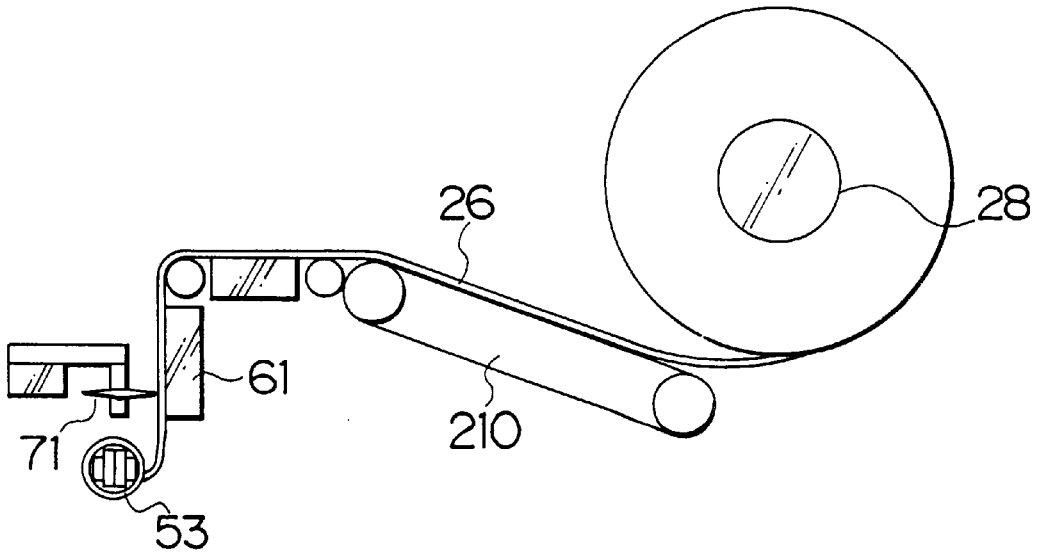
FIG. 10 is a view of assistance in explaining the essential parts of another embodiment for the web splicing preparation apparatus.

FIGS. 9 and 10 illustrate the structure of other embodiments for the web splicing preparation apparatus.

FIG. 9 is a view illustrating a state where the leading end of the new web 26 is brought onto a suction conveyor 210 by the end pull-out device (not shown) after the original roll positioning unit (not shown) positions the new roll 27. The suction conveyor 210 is sucking and rotated, and the core 28 is rotated at the same time, so that the web 26 can be fed. When the leading end of the web 26 reaches the pair of the roll-up chucks 53, the feeding of the web 26 is temporarily stopped, and the roll-up chucks 53 are closed and both sides of the leading end of the web 26 are nipped. Thereafter, the web 26 is rolled up while the roll-up chucks 53 and the core 28 are rotated, and when the rolled-up length of the web 26 reaches a predetermined length, the core 28 and the roll-up chucks 53 are stopped. Then, the web 26 is fixed at the part between the roll-up chucks 53 and the suction conveyor 210 by the suction box 61, and the cutter 71 is moved so as to cut the web 26.

On the other hand, in FIG. 10, the suction conveyor 210 is sucking and rotated, and the core 28 is rotated at the same time, so that the web 26 can be fed. When the leading end of the web 26 reaches the pair of the roll-up chucks 53, the feeding of the web 26 is temporarily stopped, and the roll-up chucks 53 are closed and both sides of the leading end of the web 26 are nipped. Thereafter, the pair of the roll-up chucks 53 is moved down while the web 26 is rolled up by rotating the roll-up chucks 53 and the core 28. When the downward movement of the roll-up chucks 53 is completed and the rolled-up length of the web 26 reaches a predetermined length, the core 28 and the roll-up chucks 53 are stopped, and the suction box 61 fixes the web 26 at the part between the roll-up chucks 53 and the suction conveyor 210. Then, the cutter 71 is moved to cut the web 26.

In the pieces of the apparatus described in FIGS. 9 and 10, the suction conveyor 210 is used to pull out the leading end of the new web 26. For this reason, if the disposed part at the leading end of the new web 26 is extremely short (to be particular, the length of the disposed part is shorter than a length of the pass from the sending position to the cutting part), the web 26 after cutting includes the part which contacts the suction conveyor 210. To the contrary, according to the apparatus in FIG. 1, the pair of the roll-up chucks 53, which holds both sides of the leading end of the web 26, is provided with both functions of pulling out the leading end of the web 26 and rolling up the web 26, so that the suction conveyor is not necessary (though it may be necessary that the suction box 61 is lowered once when the leading end of the web 26 is pulled out of the new roll 27). Thus, the web 26 after cutting can be used as a product regardless of the disposed length.

Figure 11:
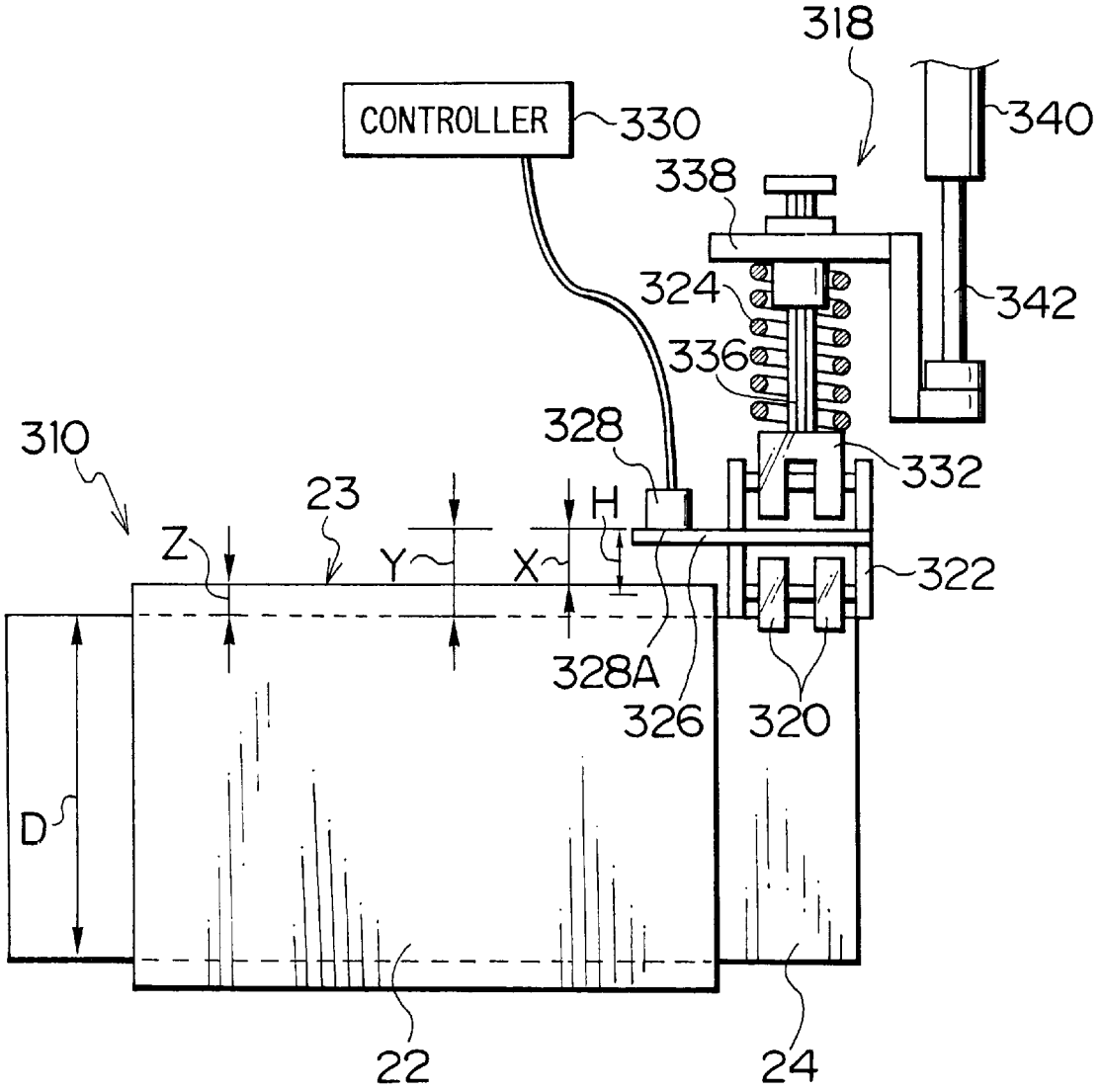
FIG. 11 is a front view illustrating a device for determining the residual length of a roll according to an embodiment of the present invention.
Figure 12:
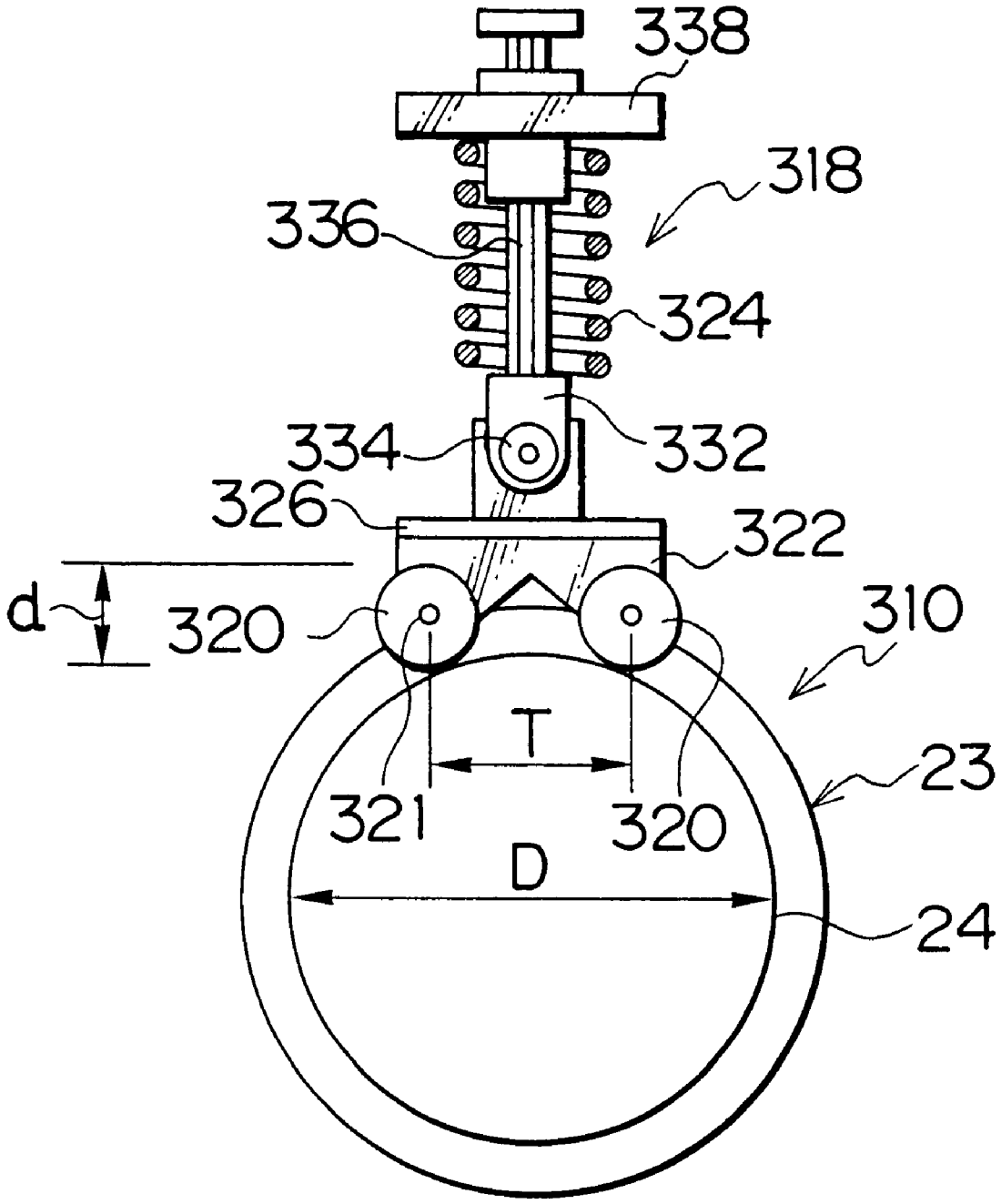
FIG. 12 is a side view illustrating the device for determining the residual length of the roll in FIG. 11.

FIG. 11 is a front view of a roll residual length determining device 318 applied to the web splicing preparation apparatus 10 in FIG. 1, and FIG. 12 is a right side view thereof. The roll residual length determining device 318 is attached to the old roll 23, and determines the residual length of the old web 22. As shown in FIG. 11, an original roll 310 consists of the web 22 and the core 24 which is wider than the web 22, and the web 22 is wound on the proximity of the central part of the core 24.

The residual length determining device 318 has a pair of rollers 320 as shown in FIG. 12. The rollers 320 are rotatably supported on a first supporting member 322 at a predetermined interval T via bearings (not shown). The rollers 320 are arranged in the circumferential direction of the core 24, and are pressed on the circumferential surface of the core 24 by a spring 324.

As shown in FIG. 11, a plate 326 is fixed to the first supporting member 322. The plate 326 stretches from the first supporting member 322 toward a position over the old roll 23. An ultrasonic sensor 328 as a distance measuring sensor is attached to the end of the plate 326 in such a manner that a detection surface 328A thereof faces to the circumferential surface of the old roll 23. The ultrasonic sensor 328 connects to a controller 330, which calculates a distance X between the detection surface 328A of the ultrasonic sensor 328 and the circumferential surface of the old roll 23 in accordance with a distance signal output from the ultrasonic sensor 328.

The first supporting member 322 is rotatably supported on a second supporting member 332 via a bearing 334 shown in FIG. 12. The second supporting member 332 is movably supported on an L-shaped third supporting member 338 via a linear bearing 336 and the spring 324. The third supporting member 338 connects to a rod 342 of an air cylinder 340, and is moved up and down by expansion and contraction of the rod 342. For example, if the rod 342 expands in FIG. 11, the third supporting member 338 is moved down against a force of the spring 324. Thereby, the spring 324 contracts, and the force of the spring 324 which is generated at that time, is transmitted to the rollers 320 through the second supporting member 332 and the first supporting member 322. Thus, the rollers 320 are pressed on the circumferential surface of the core 24, and the roll residual length determining device 318 is fixed on the core 24. A moving mechanism such as a single shaft robot may be used instead of the air cylinder 340.

On the other hand, a distance Y between the detection surface 328A of the ultrasonic sensor 328 and the circumferential surface of the core 24 is previously stored in the controller 330. The distance Y is calculated according to a diameter D of the core 24, the interval T between shafts 321 supporting the rollers 320, a diameter d of the roller 320, and a distance H between the shaft 321 of the roller 320 and the detection surface 328A of the ultrasonic sensor 328. The residual length determining device 318 may be fixed on an empty core (with no product wound thereon) once, so as to calculate the distance Y in accordance with the distance signal from the ultrasonic sensor 328. If the interval T between the shafts 321 of the rollers 320 is much smaller than the diameter D of the core 24, variation in the distance Y is negligible.

Next, an explanation will be given about the operation of the roll residual length determining device 318 which is constructed in the above-mentioned manner.

The diameter of the old roll 23 in use is estimated according to the feeding speed of the old web 22 and the rotating speed of the core 24 of the old roll 23. When the diameter of the old roll 23 is estimated to be less than a predetermined value, which is much larger than the diameter of the core 24, the rod 342 of the air cylinder 340 expands, and the rollers 320 are pressed on the circumferential surface of the core 24 so that the residual length determining device 318 can be fixed on the core 24.

Then, the ultrasonic sensor 328 and the controller 330 are activated. The controller 330 subtracts the distance X, which is measured with the ultrasonic sensor 328, from the previously-stored distance Y between the ultrasonic sensor 328 and the circumferential surface of the core 24 to alculate the thickness Z of the old roll 23 on the core 24. Then, the controller 330 calculates the residual length L of the old roll 23 using the ollowing equation:

$$\begin{aligned} L &= 1/4\times\pi\times\{(D+2\times Z)^2 - D^2\}/t \\ &= \pi\times Z(D+Z)/t \\ &\approx \pi\times D\times Z/t \qquad (\because D \gg Z) \end{aligned}$$

where t is the thickness of the web 22, and D is not an experimental value of the diameter of the core 24 but a reference value.

In this embodiment, the thickness Z of the old roll 23 is measured based on the circumferential surface of the core 24. Thereby, even if the diameters of the cores are not fixed, the residual length of the old roll 23 can be correctly determined.

Figure 13:
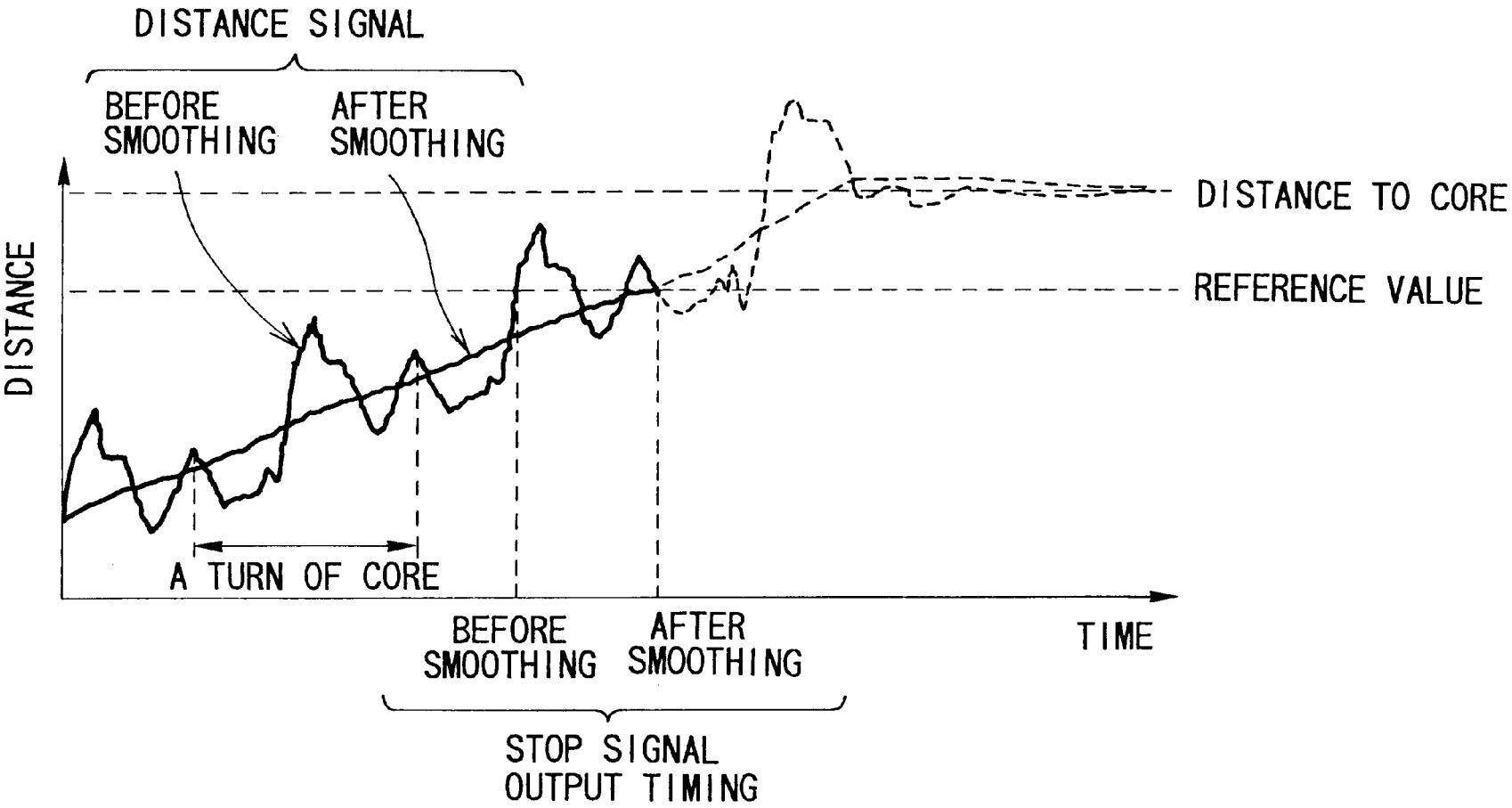
FIG. 13 is a view of assistance in explaining one example of a smoothing process performed by a controller.

FIG. 13 is a graph showing an example of the reference value, the distance signal and stop signal output timing before and after the smoothing process. As shown in FIG.

13, the serrate distance signal output from the ultrasonic sensor 328 is smoothed and compared with the reference value where the substantially whole length of the old web 22 is fed from the core 24 and the core 24 can be stopped safely. When the smoothed distance reaches the reference value, the controller 330 outputs the stop signal so that the feeding of the web 22 can be stopped. Thus, in this embodiment, the substantially whole length of the web can be fed from the core and the core can be stopped safely.

In this embodiment the ultrasonic sensor 328 is used as the distance measuring sensor; however, the present invention should not be restricted to this. Any non-contact sensor may be used if it outputs an analog signal corresponding to the distance.

As set forth hereinabove, according to the web splicing preparation method and apparatus of the present invention, a sequence of processes for preparing the new roll including the step of disposing the outermost part of the new roll can be automatically performed, and the outermost part of the new roll can be automatically rolled up to be a small roll and disposed. The positional accuracy can be obtained not only in the width direction but the longitudinal direction of the splicing part of the new and old rolls, and the splicing can be automatically performed.

In the present invention, the operator does not have to prepare the new roll and collect the scrap web every time the rolls are exchanged. The apparatus can be operated fully automatically, and the ISO hole required for splicing can be automatically punched before the splicing operation. Furthermore, the finished products can be of a high quality because there is no scratch on the new web.

Furthermore, according to the roll residual length determining device of the present invention, at least a pair of rollers are pressed on the circumferential surface of the core, and the distance measuring sensor is attached to the supporting member which rotatably supports the pair of rollers. The detection surface of the distance measuring sensor faces to the surface of the roll, and the thickness of the roll is measured based on the circumferential surface of the core. Thus, even if the diameters of the cores vary, the operator does not have to measure the diameters of the cores, and the residual length of the roll can be determined automatically and accurately.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web splicing preparation method of preparing for splicing a trailing end of an old web of an old roll with a splicing part of a new web of a new roll, said method comprising the steps of:

rolling up a leading end of said new web at a predetermined length with end roll-up means, wherein end pull-out means pulls out the leading end of said new web from said new roll and brings the pulled-out leading end of said new web to said end roll-up means;

moving said end roll-up means to unwind said new web from said new roll;

holding said new web at a part between the rolled-up leading end and said new roll with holding means;

cutting off the rolled-up leading end of said new web from the held part of said new web with cutting means, and thereby forming said splicing part; and having the splicing part of said new web wait in a state of being held with said holding means until the start of splicing operation.

2. The web splicing preparation method as defined in claim 1, wherein said end roll-up means holds both sides of the leading end of said new web and rolls up the leading end of said new web.

3. The web splicing preparation method as defined in claim 1, wherein the cut-off leading end of said new web after being rolled-up is fixed with adhesive tape in the rolled-up state and is put in storage.

4. A web splicing preparation apparatus which prepares for splicing a trailing end of an old web of an old roll with a splicing part of a new web of a new roll, comprising:

end roll-up means for rolling up a leading end of said new web at a predetermined length;

end pull-out means for pulling out the leading end of said new web from said new roll and bringing the pulled-out leading end of said new web to said end roll-up means;

moving means for moving said end roll-up means in a direction to unwind said new web from said new roll;

holding means for holding said new web at a part between the rolled-up leading end and said new roll; and cutting means for cutting off the rolled-up leading end of said new web from the held part of said new web.

5. The web splicing preparation apparatus as defined in claim 4, wherein said end roll-up means comprises:

a pair of roll-up chucks for holding respective sides of the leading end of said new web and rolling up the leading end of said new web;

a motor for driving said pair of roll-up chucks; and torque controlling means for controlling torque transmitted from said motor to said pair of roll-up chucks.

6. The web splicing preparation apparatus as defined in claim 5, wherein the transmitted torque is controlled between 1.5 kgf and 3.0 kgf on a circumferential surface of said roll-up chuck.

7. The web splicing preparation apparatus as defined in claim 4, wherein a moving speed $V_t$ of said end roll-up means in the direction to unwind said new web, a roll-up speed $V_m$ of said end roll-up means, and a web feeding speed $V_u$ of said new roll have the following relation:

$$V_u - V_m \leqq V_t \leqq V_u.$$

8. The web splicing preparation apparatus as defined in claim 4, further comprising a roll residual length determining device for determining residual length of said old web of said old roll; said roll residual length determining device comprising:

a pair of rollers for pressing on a circumferential surface of a core of said old roll;

a supporting member for rotatably supporting said pair of rollers;

a distance measuring sensor for measuring a distance to a circumferential surface of said old roll and outputting a distance signal representing the distance, said distance measuring sensor having a detection surface facing said circumferential surface of said old roll and being fixed to said supporting member; and a controller for calculating the residual length of said old web of said old roll according to the distance signal output from said distance measuring sensor, a previously-stored distance between said circumferential surface of said core of said old roll and said distance measuring sensor and thickness of said old web, and for stopping feeding said old web when the calculated residual length of said old web is less than a reference value.

9. The web splicing preparation apparatus as defined in claim 8, wherein said distance measuring sensor is an ultrasonic sensor.

10. The web splicing preparation apparatus as defined in claim 8, wherein said controller smoothes the distance signal output from said distance measuring sensor, and calculates the residual length of said old web of said old roll according to the smoothed distance signal.

11. The web splicing preparation apparatus as defined in claim 10, wherein said distance measuring sensor is an ultrasonic sensor.

12. A web splicing preparation method of preparing for splicing a trailing end of an old web of an old roll with a splicing part of a new web of a new roll, said method comprising the steps of:

using an end pull-out device to pull out a leading end of a new web from said new roll and transport the pulled-out leading end of the new web to an end roll-up device;

rolling up a leading end of said new web at a predetermined length with the end roll-up device;

moving the end roll-up device to unwind said new web from said new roll;

holding said new web at a part between the rolled-up leading end and said new roll with a holding device; and cutting off the rolled-up leading end of said new web from the held part of said new web with a cutter thereby forming said splicing part.

13. The web splicing preparation method as defined in claim 12, further comprising the step of holding, with said end roll-up device, both sides of the leading end of said new web while rolling up the leading end of said new web.

14. The web splicing preparation method as defined in claim 12, further comprising the steps of fixing the cut-off leading end of the new web in a rolled-up state, with adhesive tape, and putting the fixed rolled-up cut-off leading end into a storage area.

15. The web splicing preparation method as defined in claim 12, further comprising the step of punching the leading end of said new web with an ISO hole while the leading end of said new web is held with said holding device.

16. A web splicing preparation apparatus which prepares for splicing a trailing end of an old web of an old roll with a splicing part of a new web of a new roll, comprising:

a web supply portion, and a web splicing portion adjacent said web supply portion;

an end pull out unit mounted adjacent said web supply portion such that said end pull out unit is movable in two dimensions;

an end roll-up unit, separate from said end pull out unit, mounted for movement between said web supply portion and said web splicing portion, wherein said end roll-up unit includes a pair of roll-up chucks mounted to hold opposite side edges of said new web, and a motor to rotate said roll-up chucks;

a holding device, mounted in said web splicing portion; and a cutter mounted adjacent said holding device.

17. The web splicing preparation apparatus as defined in claim 16, further comprising an ISO hole punching unit adjacent said holding device.

* * * * *